US009271543B2

(12) United States Patent
Sills

(10) Patent No.: US 9,271,543 B2
(45) Date of Patent: Mar. 1, 2016

(54) ARTICLE OF FOOTWEAR WITH SUPPORT ASSEMBLY HAVING SEALED CHAMBER

(75) Inventor: Craig K. Sills, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 401 days.

(21) Appl. No.: 13/348,287

(22) Filed: Jan. 11, 2012

(65) Prior Publication Data

US 2013/0174447 A1 Jul. 11, 2013

(51) Int. Cl.

| | |
|---|---|
| ***A43B 5/00*** | (2006.01) |
| ***A43B 7/16*** | (2006.01) |
| ***A43B 13/28*** | (2006.01) |
| ***A43B 13/18*** | (2006.01) |
| ***A43B 13/20*** | (2006.01) |
| ***A43B 21/32*** | (2006.01) |

(52) U.S. Cl.
CPC ..... *A43B 13/181* (2013.01); *A43B 13/20* (2013.01)

(58) Field of Classification Search
CPC ..... A43B 13/141; A43B 13/148; A43B 13/185–13/189; A43B 7/144
USPC ..... 36/83, 92, 27–28, 35 R, 37
See application file for complete search history.

(56) References Cited

U.S. PATENT DOCUMENTS

| | | | | |
|---|---|---|---|---|
| 4,129,951 | A | 12/1978 | Petrosky | |
| 4,798,009 | A | 1/1989 | Colonel et al. | |
| 5,233,767 | A * | 8/1993 | Kramer | 36/28 |
| 5,595,003 | A | 1/1997 | Snow | |
| 6,253,466 | B1 * | 7/2001 | Harmon-Weiss et al. | 36/28 |
| 6,880,267 | B2 * | 4/2005 | Smaldone et al. | 36/28 |
| 7,152,342 | B2 * | 12/2006 | Sommer | 36/25 R |
| 7,159,338 | B2 * | 1/2007 | LeVert et al. | 36/27 |
| 7,401,418 | B2 | 7/2008 | Wyszynski et al. | |
| 7,437,835 | B2 * | 10/2008 | Marvin et al. | 36/29 |
| 7,644,462 | B2 | 1/2010 | Wyszynski et al. | |
| 7,707,745 | B2 * | 5/2010 | Schindler et al. | 36/29 |
| 7,748,141 | B2 * | 7/2010 | Smith et al. | 36/28 |
| 7,774,955 | B2 | 8/2010 | Goodwin et al. | |
| 7,797,856 | B2 | 9/2010 | Andrews et al. | |
| 7,841,105 | B2 | 11/2010 | Wyszynski et al. | |
| 2005/0252037 | A1 | 11/2005 | Hofmann | |
| 2005/0268490 | A1 * | 12/2005 | Foxen | 36/28 |
| 2008/0276491 | A1 | 11/2008 | Gaensler et al. | |
| 2009/0211114 | A1 | 8/2009 | Ivester et al. | |
| 2009/0241376 | A1 * | 10/2009 | Robson et al. | 36/92 |
| 2010/0192420 | A1 | 8/2010 | Favraud | |
| 2011/0067263 | A1 | 3/2011 | Wyszynski et al. | |

* cited by examiner

*Primary Examiner* — Robert J Hicks
*Assistant Examiner* — Timothy K Trieu
(74) *Attorney, Agent, or Firm* — Banner & Witcoff, Ltd.

(57) ABSTRACT

An article of footwear is disclosed and includes an upper and a support assembly positioned beneath the upper. The support assembly may include a top member, a chamber assembly positioned beneath the top member, having a base member and a plurality of hollow support members extending upwardly from the base member. A bottom plate may be secured to a bottom surface of the chamber assembly, sealing the hollow projections and forming at least one closed chamber. An outsole may be positioned beneath the support assembly.

19 Claims, 3 Drawing Sheets

ARTICLE OF FOOTWEAR WITH SUPPORT ASSEMBLY HAVING SEALED CHAMBER

FIELD

Aspects of this invention relate generally to an article of footwear with an improved sole assembly and, in particular, to an article of footwear having a sole assembly including at least one sealed chamber.

BACKGROUND

Conventional articles of athletic footwear generally include two primary elements, an upper and a sole structure. The upper is secured to the sole structure and forms a void on the interior of the footwear for comfortably and securely receiving a foot. The sole structure is secured to a lower portion of the upper and is positioned between the foot and the ground. The sole structure generally incorporates multiple layers that are conventionally referred to as an insole, a midsole, and an outsole. The insole, or sockliner, is a thin, compressible member located within the void and proximate a lower surface of the foot to enhance footwear comfort. The midsole, which is conventionally secured to the upper along the length of the upper, forms a middle layer of the sole structure and is primarily responsible for attenuating ground (or other contact surface) reaction forces to lessen stresses upon the foot and leg. The outsole forms a ground-engaging portion (or other contact surface-engaging portion) of the sole structure, and is formed from a durable and wear-resistant material that includes texturing to improve traction.

The conventional midsole is primarily formed from a resilient, polymer foam material that extends throughout the length of the footwear, which may be by way of an injection molding process. The properties of the polymer foam material in the midsole are primarily dependent upon factors that include the dimensional configuration of the midsole and the specific characteristics of the material selected for the polymer foam, including the hardness or density of the polymer foam material. By varying these factors throughout the midsole, the relative stiffness and degree of ground reaction force attenuation may be altered to meet the specific demands of the activity for which the footwear is intended to be used. In addition to polymer foam materials, conventional midsoles may include, for example, one or more fluid-filled bladders and moderators.

It would be desirable to provide a sole assembly that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide footwear with improved support. In accordance with a first aspect, an article of footwear includes an upper and a support assembly positioned beneath the upper. The support assembly includes a top member, a chamber assembly positioned beneath the top member, having a base member and a plurality of hollow support members extending upwardly from the base member, with, a top surface of the hollow support members contacting the top member. A bottom plate is secured to a bottom surface of the chamber assembly, sealing the hollow support members and forming at least one closed chamber. An outsole may be positioned beneath the support assembly.

In accordance with another aspect, the top member may include an upwardly extending peripheral wall, and the wall may have a height that decreases from a maximum height at a rear of the top member to a minimum height at a front of the top member.

In accordance with a further aspect, an article of footwear may include an upper and a support assembly positioned beneath the upper. The support assembly may include a top member having a plurality of ribs on a bottom surface thereof, each rib defining a recess; a chamber assembly having a base member and a plurality of support members extending upwardly from the base member, a portion of each support member being seated in one of the recesses of the top member, with a top surface of each hollow support member contacting the top member. A bottom plate is secured to a bottom surface of the chamber assembly, sealing the hollow support members and forming at least one closed chamber. An outsole may be positioned beneath the support assembly.

In accordance with other aspects, an article of footwear includes an upper and a sole assembly positioned beneath the upper. The sole assembly may include a support assembly positioned beneath a midfoot portion and a heel portion of the upper. The support assembly may include a top member secured to the upper having a plurality of ribs on a bottom surface thereof, each rib defining a recess, and an upwardly extending peripheral wall extending about a portion of a periphery of the top member. A chamber assembly has a base member and a plurality of hollow projections extending upwardly from the base member, a portion of each projection being seated in one of the recesses of the top member, with a top surface of each projection contacting the top member. A bottom plate is secured to a bottom surface of the chamber assembly, sealing the hollow projections and forming at least one closed chamber. A midsole is positioned beneath a forefoot portion of the upper. An outsole is positioned beneath the support assembly and the midsole.

By providing an article of footwear with a support assembly including a sealed chamber, a user can be provided with increased support. These and additional features and advantages disclosed here will be further understood from the following detailed disclosure of certain embodiments.

Figure 1:
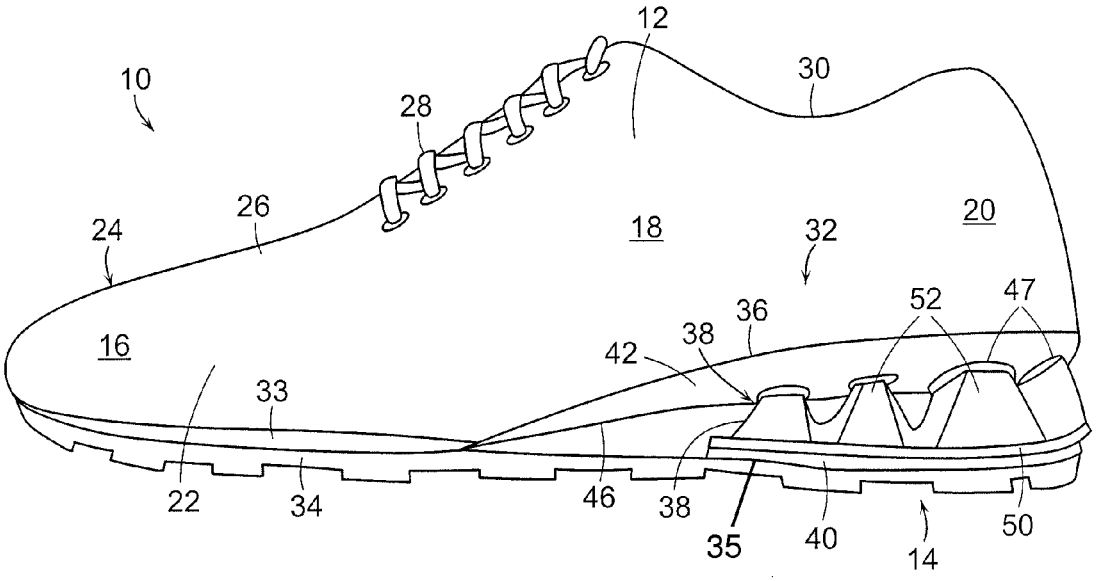
FIG. 1 is an elevation view of an article of footwear having a support assembly including a chamber assembly having a plurality of sealed chambers.
Figure 2:
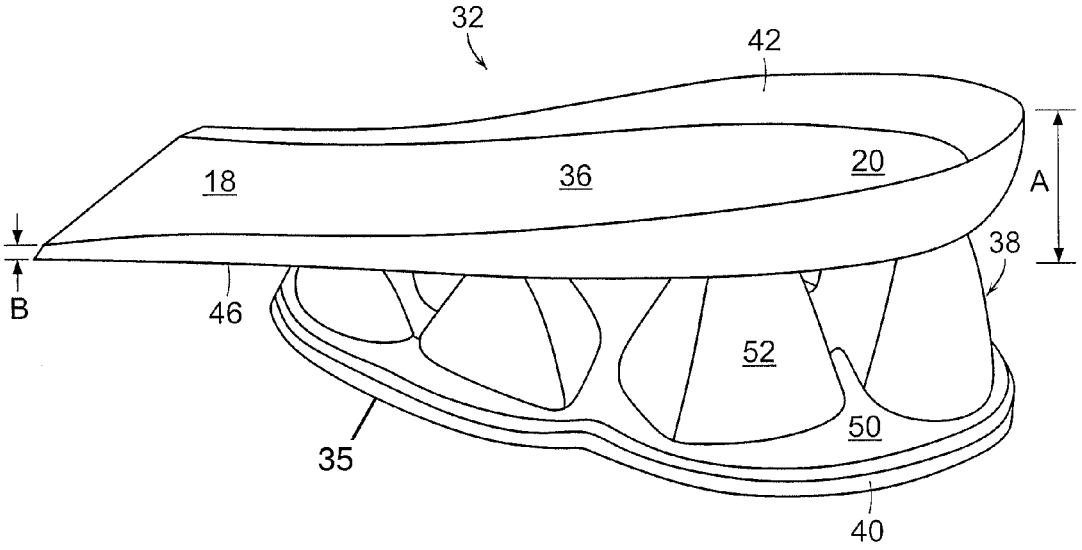
FIG. 2 is a perspective view of the support assembly of the footwear of FIG. 1.

The figures referred to above are not drawn necessarily to scale, should be understood to provide a representation of particular embodiments of the invention, and are merely conceptual in nature and illustrative of the principles involved. Some features of the footwear with a support assembly having sealed chambers depicted in the drawings have been enlarged or distorted relative to others to facilitate explanation and understanding. The same reference numbers are used in the drawings for similar or identical components and features shown in various alternative embodiments. Footwear with a support assembly having sealed chambers as disclosed herein would have configurations and components determined, in part, by the intended application and environment in which they are used.

DETAILED DESCRIPTION OF CERTAIN PREFERRED EMBODIMENTS

An article of footwear 10 is depicted in FIG. 1 as including an upper 12 and a sole assembly 14. Article of footwear 10 can be any of various articles of casual footwear having configurations suitable, for example, for walking or lounging. Footwear 10 may also be one of a wide range of athletic footwear styles, including shoes that are suitable for soccer, running, basketball, baseball, cross-training, football, rugby, tennis, and volleyball, for example. An individual skilled in the relevant art will appreciate, therefore, that the concepts disclosed herein with regard to footwear 10 may be applied to a wide variety of footwear styles, in addition to the specific styles discussed herein and depicted in the accompanying figures.

For purposes of reference in the following description, footwear 10 may be divided into three general regions: a forefoot region 16, a midfoot region 18, and a heel region 20. Regions 16-20 are not intended to demarcate precise areas of footwear 10. Rather, regions 16-20 are intended to represent general areas of footwear 10 that provide a frame of reference during the following discussion. Although regions 16-20 apply generally to footwear 10, references to regions 16-20 also may apply specifically to upper 12, sole assembly 14, or individual components within either upper 12 or sole assembly 14.

Upper 12 defines a void or chamber for receiving a foot. For purposes of reference, upper 12 includes a lateral side 22, an opposite medial side 24, and a vamp or instep area 26. Lateral side 22 is positioned to extend along a lateral side of the foot (i.e., the outside) and generally passes through each of regions 16-20. Similarly, medial side 24 is positioned to extend along an opposite medial side of the foot (i.e., the inside) and generally passes through each of regions 16-20. Upper 12 may also include a closure mechanism, such as lace 28. Upper 12 also includes an ankle opening 30 that provides the foot with access to the void within upper 12.

Sole assembly 14 includes a support assembly 32 positioned below upper 12. Support assembly 32 serves to provide shock-attenuation and energy-absorption for footwear 10. In certain embodiments, support assembly 32 may be directly secured to upper 12. Support assembly 32 may be secured to upper 12 with an adhesive, for example. Suitable adhesives are well known in the art and need not be discussed in greater detail here. Support assembly 32 may be secured to upper 12 with any other suitable fastening means, and such other suitable means of fastening support assembly 32 to upper 12 will become readily apparent to those skilled in the art, given the benefit of this disclosure.

In certain embodiments, a midsole 33 is also positioned beneath upper 12 in an area where support assembly 32 does not extend. In the embodiment illustrated here, support assembly 32 extends from beneath upper 12 from midfoot area 18 to heel area 20, while midsole 33 extends from beneath forefoot portion 16 to midfoot area 18 of upper 12. It is to be appreciated that support assembly 32 can extend beneath the entirety of upper 12 or any portion thereof.

Suitable materials for midsole 33 include any of the conventional polymer foams that are utilized in footwear midsoles, including ethyl vinyl acetate (EVA) and polyurethane (PU) foam. Other suitable materials for midsole 33 will become readily apparent to those skilled in the art, given the benefit of this disclosure.

An outsole 34 is positioned below support assembly 32. In certain embodiments, outsole 34 is directly secured to support assembly 32. In certain embodiments, outsole 34 may also be directly secured to midsole 33. Outsole 34 may be secured to support assembly 32 and/or midsole 33 with an adhesive, for example. Suitable adhesives are well known in the art and need not be discussed in greater detail here. Other suitable means of fastening outsole 34 to support assembly 32 and midsole 33 will become readily apparent to those skilled in the art, given the benefit of this disclosure.

In certain embodiments, outsole 34 may be formed of a layer of material secured to and extending over the bottom surface 35 of support assembly 32. In other embodiments, outsole 34 may be formed of a plurality of individual elements secured to the bottom surface of support assembly 32. Suitable materials for outsole 34 include any of the conventional rubber materials that are utilized in footwear outsoles, such as carbon black rubber compound. Other suitable materials for outsole 34 will become readily apparent to those skilled in the art, given the benefit of this disclosure.

As seen in FIGS. 2-6, support assembly 32 includes an upper or top member 36, a chamber assembly 38 positioned below top member 36, and a bottom plate 40 positioned below chamber assembly 38. In certain embodiments, as seen most clearly in FIG. 2, top member 36 may include an upwardly extending peripheral wall 42. Peripheral wall 42 serves to capture a portion of heel portion 20 of upper 12, thereby helping register support assembly 32 with respect to upper 12, and provide additional lateral support for the user of footwear 10. In certain embodiments, peripheral wall 42 decreases in height from a maximum height A at a rear of top member 36 to a minimum height B at a front of top member 36.

Figure 3:
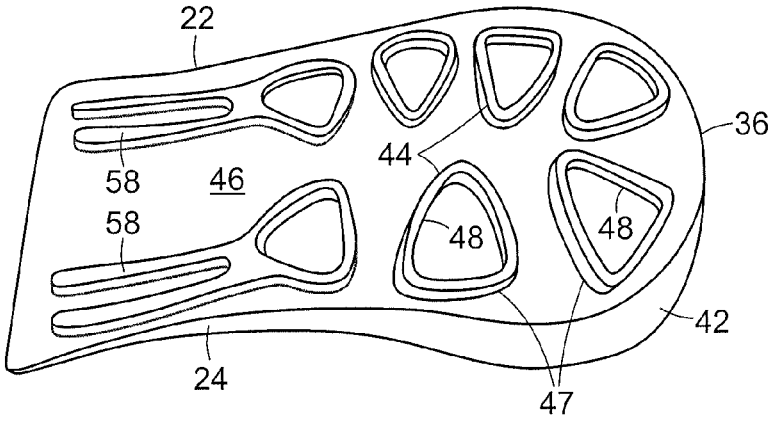
FIG. 3 is a perspective view of a top member of the support assembly of FIG. 1, shown in an inverted position.

As seen in FIG. 3, top member 36 (shown here in an inverted position) includes a plurality of ribs 44 that project downwardly from a lower or bottom surface 46 of top member 36 and define corresponding retaining members 47 with recesses 48 formed therein. In a preferred embodiment, top member 36 includes three retaining members 47 positioned along medial side 24 and four retaining members 47 positioned along lateral side 22. It is to be appreciated that any desired number of retaining members 47 may be positioned on top member 36, and at any desired location.

As seen in FIGS. 2 and 4-6, chamber assembly 38 includes a base member 50 and a plurality of hollow support members 52 above base member 50. Base member 50 includes a peripheral rim 51. Hollow support members 52 may be projections that extend upwardly from base member 50, with corresponding apertures 53 formed in base member 50 such that the hollow interior of each support member 52 is exposed to the exterior of support member 52. An entirety of each hollow support member 52 is positioned inwardly from peripheral rim 51.

In certain embodiments, base member 50 is a substantially planar member. It is to be appreciated that base member 50 may vary slightly from being strictly planar, and may include some contour to conform to and help define part of the bottom of footwear 10.

Top member 36, chamber assembly 38, bottom plate 40, and base member 50 of support assembly 32 may be formed of thermoplastic polyurethane (TPU). In certain embodiments, bottom plate 40 may be formed of a TPU film. Other suitable materials for the elements of support assembly 32 will become readily apparent to those skilled in the art, given the benefit of this disclosure.

An upper portion of each support member 52 is received within a recess 48 of a corresponding retaining member 47 of top member 36, such that an upper or top surface of each support member 52 contacts a bottom surface of top member 36. The engagement of the upper portion of support members 52 within recesses 48 of retaining members 47 serves to align and register support members 52 with respect to top member 36.

Bottom plate 40 extends across, and is secured to a bottom or lower surface of base member 50 of chamber assembly 38. Securing bottom plate 40 to base member 50 of chamber assembly 38 seals hollow support members 52, thereby defining a plurality of sealed or closed chambers 54 formed in the hollows of support members 52. In certain embodiments, chambers 54 are occupied with air. However, it is to be appreciated that chambers 54 may be filled with any desired material, whether it be a liquid, solid, or gas. In certain embodiments, chambers 54 may be filled with any of nitrogen, helium, hexafluoroethane, sulfur hexafluoride, and octafluoropropane, for example, optionally under ambient pressure or at an elevated pressure.

Bottom plate 40 may be secured to base member 50 with an adhesive, for example. Suitable adhesives are well known in the art and need not be discussed in greater detail here. Bottom plate 40 may be secured to base member 50 with any other suitable fastening means, and such other suitable fastening means will become readily apparent to those skilled in the art, given the benefit of this disclosure.

Figure 6:
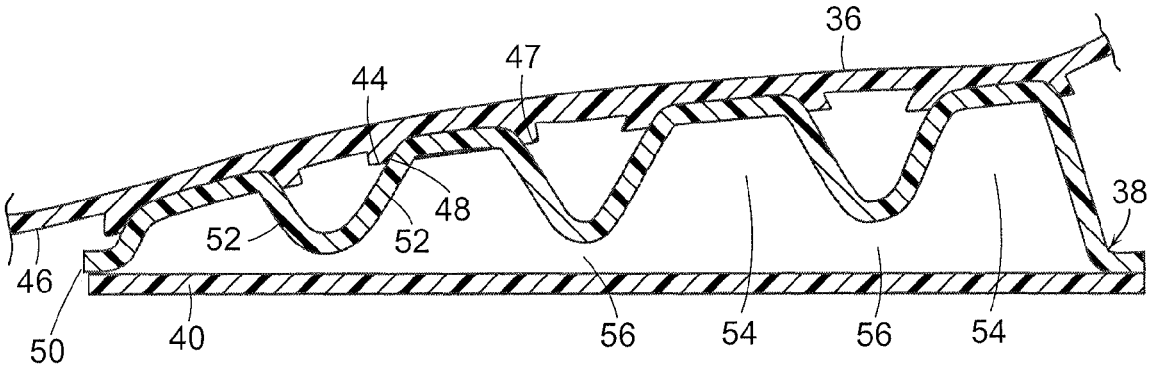
FIG. 6 is a section view of the support assembly of FIG. 1.

In certain embodiments, as illustrated in FIG. 6, passageways 56 may extend between one or more adjacent chambers 54, thereby making one or more chambers 54 in fluid communication with other chambers 54. This produces a larger chamber formed of the individual chambers 54 of each support member 52. It is to be appreciated that some, all, or none of the chambers could be connected to adjacent chambers 54 with a passageway 56. It is to be noted that in areas where adjacent chambers 54 are not connected to one another by a passageway 56, that the support members would directly contact bottom plate 40.

Figure 4:
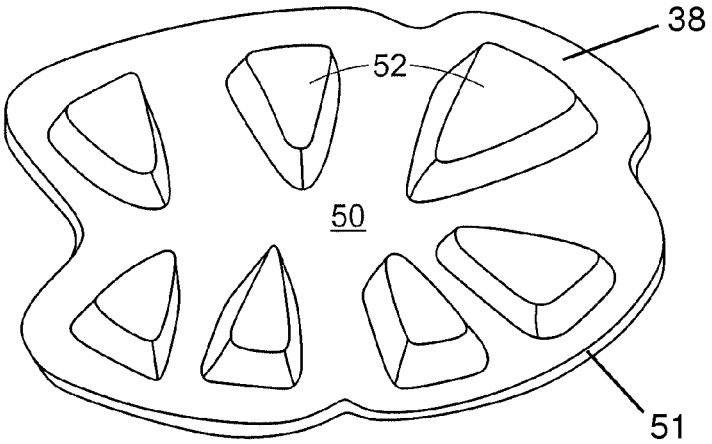
FIG. 4 is a perspective view of the chamber assembly of the support assembly of FIG. 1.
Figure 5:
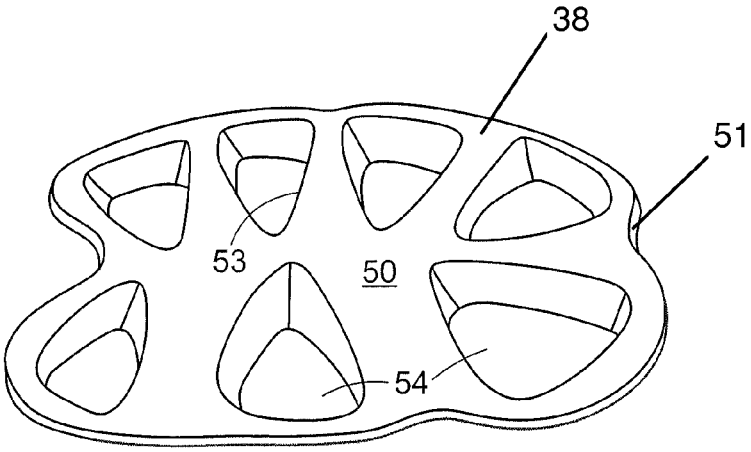
FIG. 5 is a perspective view of the chamber assembly of the support assembly of FIG. 1, shown in an inverted position.

In certain embodiments, as seen in FIGS. 3-5, one or more support members 52, and corresponding retaining members 47 may have a substantially triangular shape. In certain embodiments, one or more support members 52, and corresponding retaining members 47 may have a substantially teardrop shape. It is to be appreciated that support members 52 and retaining members 47 may have any desired shape. Other suitable shapes for support members 52 and retaining members 47 will become readily apparent to those skilled in the art, given the benefit of this disclosure.

In certain embodiments, as illustrated in FIG. 3, one or more support ribs 58 may extend longitudinally along bottom surface 46 of top member 36. In the illustrated embodiment, a first pair of support ribs 58 extend forwardly from a forwardmost retaining member 47 on lateral side 22, and a second pair of support ribs 58 extend forwardly from a forwardmost retaining member 47 on medial side 24. Support ribs 58 serve to provide additional support and rigidity to top member 36.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising:

an upper;

a support assembly positioned beneath the upper and comprising:

a top member;

a chamber assembly positioned beneath the top member, having a base member, the base member including a planar top surface including a peripheral rim extending about an entire periphery of the top surface, a plurality of hollow support members extending upwardly from the base member, an entirety of each of the hollow support members being positioned inwardly from the peripheral rim, and a plurality of apertures formed in the base member such that a hollow interior of each support member is exposed to an exterior of the chamber assembly, a top surface of the hollow support members contacting the top member; and a bottom plate secured to a bottom surface of the chamber assembly, sealing the hollow support members and forming at least one closed chamber; and an outsole positioned beneath the support assembly.

2. The article of footwear of claim 1, wherein the support assembly extends from a midfoot portion of the upper to a heel portion of the upper.

3. The article of footwear of claim 1, wherein the top member includes an upwardly extending peripheral wall.

4. The article of footwear of claim 3, wherein the peripheral wall has a height that decreases from a maximum height at a rear of the top member to a minimum height at a front of the top member.

5. The article of footwear of claim 1, wherein at least one of the support members has a substantially triangular cross-section.

6. The article of footwear of claim 1, wherein at least one of the support members has a substantially teardrop cross-section.

7. The article of footwear of claim 1, wherein the support assembly includes three support members positioned along a medial side of the chamber assembly and four support members positioned along a lateral side of the chamber assembly.

8. The article of footwear of claim 1, further comprising a plurality of ribs on a bottom surface of the top member, each rib defining a recess that receives a portion of a corresponding support member.

9. An article of footwear comprising:

an upper;

a support assembly positioned beneath the upper and comprising:

a top member having a plurality of ribs on a bottom surface thereof, each rib defining a recess;

a chamber assembly having a base member, the base member including a planar top surface including a peripheral rim extending about an entire periphery of the top surface, a plurality of hollow support members extending upwardly from the base member, an entirety of each of the hollow support members being positioned inwardly from the peripheral rim, and a plurality of apertures formed in the base member such that a hollow interior of each support member is exposed to an exterior of the chamber assembly, a portion of each hollow support member being seated in one of the recesses of the top member and a top surface of each hollow support member contacting the top member; and a bottom plate secured to a bottom surface of the chamber assembly, sealing the hollow support members and forming at least one closed chamber; and an outsole positioned beneath the support assembly.

10. The article of footwear of claim 9, wherein the support assembly extends from a midfoot portion of the upper to a heel portion of the upper.

11. The article of footwear of claim 9, wherein the peripheral wall has a height that decreases from a maximum height at a rear of the top member to a minimum height at a front of the top member.

12. The article of footwear of claim 9, wherein at least one of the support members has a substantially triangular cross-section.

13. The article of footwear of claim 9, wherein at least one of the support members has a substantially teardrop cross-section.

14. The article of footwear of claim 9, wherein the support assembly includes three support members positioned along a medial side of the chamber assembly and four support members positioned along a lateral side of the chamber assembly.

15. An article of footwear comprising:

an upper; and a sole assembly positioned beneath the upper and comprising:

a support assembly positioned beneath a midfoot portion and a heel portion of the upper and comprising:

a top member secured to the upper having a plurality of ribs on a bottom surface thereof, each rib defining a recess, and an upwardly extending peripheral wall extending about a portion of a periphery of the top member;

a chamber assembly having a base member, the base member including a planar top surface including a peripheral rim extending about an entire periphery of the top surface, a plurality of hollow projections extending upwardly from the base member, an entirety of each of the hollow support projections being positioned inwardly from the peripheral rim, and a plurality of apertures formed in the base member such that a hollow interior of each projection is exposed to an exterior of the chamber assembly, with a portion of each projection being seated in one of the recesses of the top member with a top surface of each projection contacting the top member; and a bottom plate secured to a bottom surface of the chamber assembly, sealing the hollow projections and forming at least one closed chamber;

a midsole positioned beneath a forefoot portion of the upper; and an outsole positioned beneath the support assembly and the midsole.

16. The article of footwear of claim 15, wherein the peripheral wall has a height that decreases from a maximum height at a rear of the top member to a minimum height at a front of the top member.

17. The article of footwear of claim 15, wherein at least one of the support members has a substantially triangular cross-section.

18. The article of footwear of claim 15, wherein at least one of the support members has a substantially teardrop cross-section.

19. The article of footwear of claim 15, wherein the support assembly includes three support members positioned along a medial side of the chamber assembly and four support members positioned along a lateral side of the chamber assembly.

* * * * *